United States Patent [19]

Davis

[11] 3,967,770

[45] July 6, 1976

[54] INTERLOCK FOR EYE SETTING MACHINE

[75] Inventor: Daniel L. Davis, Franklin, N.J.

[73] Assignee: Lawrence Peska Associates, Inc., New York, N.Y. ; a part interest

[22] Filed: July 3, 1975

[21] Appl. No.: 592,827

[52] U.S. Cl. ..... 227/2
[51] Int. Cl.[2] ..... B21J 15/28
[58] Field of Search ..... 227/1, 2

[56] References Cited

UNITED STATES PATENTS

| | | | |
|---|---|---|---|
| 1,871,382 | 8/1932 | Meyer | 227/2 |
| 3,209,975 | 10/1965 | Tlumacki | 227/2 |
| 3,279,671 | 10/1966 | Bachman, Jr. et al. | 227/1 |
| 3,281,044 | 10/1966 | Kalning et al. | 227/1 |

*Primary Examiner*—Granville Y. Custer, Jr.
*Attorney, Agent, or Firm*—Jack D. Slobod

[57] ABSTRACT

An interlock for an eye setting machine insures the simultaneous presence of eye fasteners in each station of the eye setting press. Microswitch feeler elements at each station are connected in series with a relay coil. A normally closed contact of the relay is connected in a series circuit including a normally-open micro-switch, following a cam on the press, a solenoid for disengaging a clutch to stop the press from operating, and a normally closed manual pushbutton switch for overriding the interlock.

2 Claims, 1 Drawing Figure

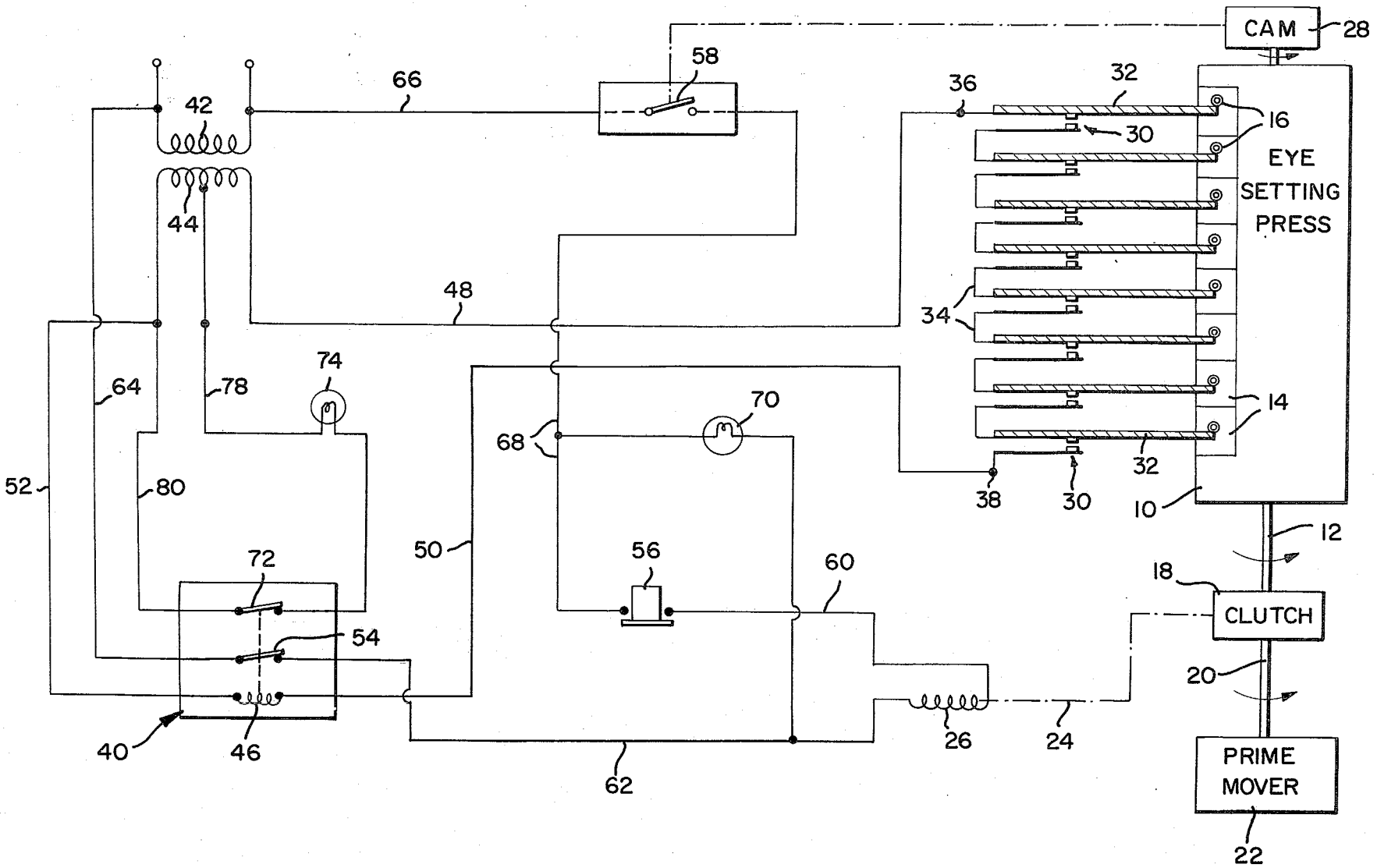
CAM
28
EYE
SETTING
PRESS
16
14
12
CLUTCH
PRIME
MOVER
22
20
18
10
32
30
24
38
36
34
26
60
70
58
56
62
68
48
50
66
74
54
72
46
78
42
44
80
64
40
52

INTERLOCK FOR EYE SETTING MACHINE

FIELD OF THE INVENTION

The present invention relates generally to interlocks for insuring the simultaneous presence of plural parts in a production machine. In its particular aspects, the present invention relates to the provision of appropriate normally open feeler switches at each part receiving station of the machine connected in a series circuit with a relay coil having a normally closed contact in another circuit with a machine cycle responsive switch for stopping the operation of the machine if a part is missing at a critical stage in the machine cycle.

BACKGROUND OF THE INVENTION

Various interlock circuits have been heretofore known which insure that plural parts have been delivered to the various stations of a production machine such as an eye setting machine. However, such devices have been quite complicated and expensive, involving a large number of relays to accomplish the desired results.

OBJECTS OF THE INVENTION

It is an object of the present invention to provide an interlock for a machine which simultaneously sets plural fasteners into a work piece, which interlock is simple, inexpensive and need involve only one relay.

It is a further object of the present invention to provide a simple means for overriding an interlock in a fastener setting machine to enable the machine to be cleared when fasteners are missing.

SUMMARY OF THE INVENTION

Briefly, the aforementioned and other objects of the present invention are satisfied by providing a separate normally open feeler switch at each station of a production machine, such as an eye setting machine, which switches are connected in series. Thus, if any fastener element is missing, there is no continuity in the aforementioned series combination. The feeler switches are also connecting in series with a relay coil having a normally closed relay contact. The contact lies in a series circuit with a normally open micro-switch for following a cam on the production machine, and a solenoid which is energizable for disengaging the usual clutch in the machine. As a result the relay contact is opened only when all fastener elements are present in the production machine, which prevents the solenoid from being energized upon closure of the cam following micro-switch.

To enable breaking the series circuit which includes the solenoid, a manual normally closed push button switch is provided in series with the solenoid. This permits a machine, which has been stopped because of missing fasteners to be turned on momentarily under supervision to clear and pick up a full load of fasteners.

Other objects, features and advantages of the present invention will become apparent upon perusal of the following detailed description of the preferred embodiment thereof when taken in conjunction with the appended drawing wherein:

FIG. 1 is an electromechanical schematic of the interlock system of the present invention.

DETAILED DESCRIPTION

Referring to FIG. 1, the interlock of the present invention is utilized with a conventional production machine for setting eye fasteners into a cloth workpiece. The machine, being well known in the art, is schematically shown in relation to its manner of interfacing with the interlock of the present invention.

Basically, the eye setting machine comprises a press 10 driven in reciprocating fashion from an input rotary drive shaft 12. The press 10 has plural spaced apart in line anvil stations 14, for example, eight as shown. Each anvil station 14 is configured to receive and hold an individual eye fastener 16. Upon reciprocation of press 10 by drive shaft 12, the anvil stations 14 are simultaneously lowered onto a workpiece (not shown) for simultaneously setting the eye fasteners 16 therein in spaced apart relationship.

The production machine as is usual, has a clutch 18 positioned between drive shaft 12 and the output shaft from a rotating prime mover 20. Prime mover 20 generally includes a flywheel (not shown) storing rotational energy to be transferred to the press 10.

Further as usual, the clutch 18 is normally engaged but is disengageable via a mechanical link 24 to a 110 volt solenoid 26. The production machine also includes the usual cam 28 coupled to drive shaft 12.

In accordance with the principles of the present invention a plurality of normally open micro-switches 30 are provided operative with fingers 32 projecting into the various anvil stations 14 to feel the presence of the eye fasteners 16 properly carried at the stations. If an eye fastener is present at a particular station, the finger 32 of the associated microswitch 30 is deflected in a manner for electrically closing the microswitch. Many different switch devices have heretofore been known for detecting the presence of eye fasteners 16 at stations 14 which are readily operable in the interlock circuitry of the present invention.

The feeler micro-switch elements 30 are connected in series by leads 34 to form a series combination having the terminals 36 and 38.

To enable the use of a single readily available 24 volt relay 40, a transformer is utilized having a 110 volt primary 42, for interfacing with a wall outlet, and a preferably center-tapped 24 volt secondary 44. The series combination of normally open switches 30 between terminals 34 and 36 is connected in a series circuit with the coil 46 of relay 40 and with transformer secondary 44 via leads 48, 50 and 52. Thus, relay coil 46 is energized only when eye fasteners 16 are present at each anvil station 14, closing each normally open switch 30.

The 110 volt solenoid 26 is connected in a second series circuit including a normally closed contact 54 of relay 40, a normally closed momentary manual push-button switch 56, a normally open microswitch 58 and the transformer primary 42 by leads 64, 62, 60, 68 and 66. Microswitch 58 follows cam 28 and is positioned angularly with respect to the cam to close electrically at an angular position of drive shaft 12, just prior to the initiation of pressing.

It should be apparent that at the instant of time when microswitch 58 is closed the solenoid 26 will be energized to disengage clutch 18, unless relay contact 54 is opened by the energization of relay coil 46. Thus, the simultaneous presence of fasteners 16 at stations 14 permits the pressing action to commence in a fail-safe manner.

The push button switch 56 is provided to prevent energization of solenoid 26 so that the production machine may be run under supervision. This permits a restart and refeed after the press 10 has been stopped because of missing fasteners 16.

To indicate that the press 10 has been stopped by the interlock of the present invention a 110 volt lamp 70 is provided in shunt with the series combination of solenoid 26 and push-button switch 56. Lamp 70 is not connected in series with switch 56 in order to provide a visual indication when the stations 14 are cleared and refed properly with fasteners 16 when restarting the machine by depressing pushbutton 56.

Preferably, in order to provide a visual indication that the press 10 and the interlock are operating properly, a second normally closed contact 72 of relay 40 is connected in a series circuit with a 12 volt lamp 74 and one half of secondary 44 via leads 78 and 80. As should be apparent, lamp 74 is extinguished each time relay 40 is energized.

Having described the preferred embodiment of the present invention in very specific detail it should be understood that numerous modifications, additions and omissions in the details thereof are possible within the intended spirit and scope of the invention.

What is claimed is:

1. In a machine for simultaneously setting plural fastener elements into a work piece, said machine having a prime-mover for rotating a drive shaft for the machine, disengageable clutch means between a fastener setting press and said prime mover, said clutch means being disengageable in response to a solenoid, and a cam carried by said press means for indicating the cyclical state of said press means, an interlock for insuring the presence of each of said plural fasteners in said press means comprising: plural normally open feeler switch means positioned for detecting the presence of properly located fasteners in said press means, each of said feeler switch means being connected electrically in a series combination, a relay coil connected between said series combination of switch means and a source of voltage, a normally open micro-switch in following relationship on said cam, configured for closing when said cam indicates a cyclical state of said press just prior to pressing of said fasteners, a normally closed relay contact associated with said relay coil, said solenoid being connected to a source of voltage via the series combination of said relay contact and said micro-switch, whereby said relay coil is energized to open said relay contact, preventing disengagement of said clutch means only if each of said feeler switch means detects a fastener at the time of closure of said micro-switch.

2. The interlock of claim 1 further comprising a normally-closed manual momentary switch in series with said solenoid for overriding the interlock.

* * * * *